United States Patent [19]

Anhalt et al.

[11] 4,021,091

[45] May 3, 1977

[54] ZERO FORCE PRINTED CIRCUIT BOARD CONNECTOR

[75] Inventors: John William Anhalt, Orange; James Harvey Curley, Costa Mesa, both of Calif.

[73] Assignee: International Telephone and Telegraph Corporation, New York, N.Y.

[22] Filed: June 13, 1975

[21] Appl. No.: 586,645

[52] U.S. Cl. ..... 339/75 MP; 339/176 MP

[51] Int. Cl.[2] ..... H01R 1/07

[58] Field of Search ..... 339/74 R, 75 MP, 176 MF, 339/176 MP

[56] References Cited

UNITED STATES PATENTS

| | | | |
|---|---|---|---|
| 3,329,926 | 7/1967 | Aksu | 339/176 MP |
| 3,492,538 | 1/1970 | Fergusson | 339/176 MP |
| 3,753,211 | 8/1973 | Pauza | 339/75 MP |
| 3,818,419 | 6/1974 | Crane | 339/74 R |
| 3,899,234 | 8/1975 | Yeager | 339/75 MP |
| 3,930,707 | 1/1976 | Vanaleck | 339/75 MP |

FOREIGN PATENTS OR APPLICATIONS

| | | | |
|---|---|---|---|
| 1,227,081 | 3/1971 | United Kingdom | 339/176 MP |

*Primary Examiner*—Roy Lake
*Assistant Examiner*—Mark S. Bicks
*Attorney, Agent, or Firm*—Thomas L. Peterson

[57] ABSTRACT

A zero force printed circuit board connector in which two rows of resilient contacts are mounted on opposite sides of a printed circuit board receiving slot in a connector housing. The upper ends of the contacts in the two rows are inclined toward each other. A hollow shell is also mounted over the contacts inside the housing and is vertically movable within the housing. The shell has a slot therein aligned with the slot in the outer housing. An elongated cam rod inside the outer housing is longitudinally movable to shift the shell downwardly to cam actuate the contacts.

9 Claims, 6 Drawing Figures

ZERO FORCE PRINTED CIRCUIT BOARD CONNECTOR

CROSS-REFERENCE TO RELATED APPLICATION

The invention disclosed in this application is related to and in some respects constitutes an improvement upon the invention disclosed in our co-pending application Ser. No. 562,552, filed on Mar. 27, 1975, entitled, "Zero Force Printed Circuit Board Connector", now Pat. No. 3,982,807.

BACKGROUND OF THE INVENTION

This invention relates generally to a printed circuit board connector and, more particularly, to a zero insertion force printed circuit board connector having cam means therein for actuating the contacts into engagement with the pads along the edge of a printed circuit board.

It is well known in the art that substantial force is required to insert a printed circuit board into a connector having a large number of spring contacts therein due to the resilient engaing force of the contacts with the edge of the board. As the number of contacts is increased in a connector, the amount of force required to insert the printed circuit board into the connector, or to withdraw it from the connector, may become excessive for practical use. In addition, the direct insertion of boards into connectors having spring contacts therein results in a wiping action occuring between the contacts and the pads on the edge of the board, which causes excessive wear of the pads over lengthy periods of use of the connector. It is therefore a common practice in the art to provide a zero insertion force printed circuit board connector in which the contacts are mounted so that they are out of the path of movement of the board when it is inserted into the connector whereby no resistance is encountered upon inserting the board thereinto. Thereafter the contacts are cam actuated into engagement with the pads on the edge of the board. When it is desired to remove the board from the connector, the cam actuation mechanism is released, so that the contacts are no longer frictionally engaging the pads on the board, thus allowing the board to be freely removed from the connector. U.S. Pat. No. 3,526,869 discloses a zero force printed circuit board connector in which a rotatable cam pushes a longitudinally movable slide cam element that cams the contacts into engagement with the pads on a printed circuit board inserted into the connector. U.S. Pat. No. 3,478,301 discloses a zero force printed circuit board connector in which the board actuates cam blocks in the connector which in turn cam the contacts into engagement with the board when the board is inserted into the connector. It is also known in the art to provide a zero force printed circuit board connector in which a movable cam on the connector housing acts directly upon the contacts to actuate them. Examples of these connectors are found in the following U.S. Pat. Nos. 3,475,717; 3,329,926; and 5,568,134. U.S. Pat. No. 3,857,577 discloses a zero force connector in which a housing is frictionally mounted downwardly over contacts secured in a substrate. Sliding downward motion of the housing cams the contacts into engagement with the printed circuit board inserted in the housing. *IBM Technical Disclosure Bulletin* entitled, "Low Voltage Pluggable Connector," by C.B. Hill et al, Vol. 8, No. 12, May 1966, discloses a zero force connector similar to that disclosed in the aforementioned U.S. Pat. No. 3,857,577 in which the housing is moved over the contact to cam them by means of screws which extend upwardly through the substrate and are threadedly received in holes in the bottom of the housing. Such an arrangement requires at least four screws, one at each corner of the connector housing, to assure that the housing is firmly and uniformly seated on the substrate so that a uniform camming force is applied to the contacts urging them into engagement with the pads on a printed circuit board mounted in the housing. The use of a number of screws to mount the housing over the contacts is obviously time consuming. Moreover, it is frequently very inconvenient if not impossible, to actuate screws from the bottom of a mounting substrate for a connector housing in an electronic packaging assembly.

It is the purpose of the present invention to provide a zero force printed circuit board connector of the general type disclosed in the aforementioned IBM bulletin with a cam actuating mechanism which moves the housing in a uniform, controlled manner over the contacts to simultaneously and uniformly cam the contacts into engagement with a printed circuit board mounted within the connector housing. It is also a purpose of this invention to provide such a connector in which the cam actuating mechanism is mounted in a position where it is easily accessible for operation by the user, and allows actuation of the housing with only a single simple motion, thus overcoming the disadvantages of the aforementioned IBM connector. Another object of the invention is to provide a zero force printed circuit board connector which is actuated with only a minimum amount of force.

SUMMARY OF THE INVENTION

According to the principal aspect of the present invention, there is provided a zero force printed circuit board connector in which resilient contacts, preferably arranged in two opposed rows, are mounted in a mounting member. The contacts have upper contacting portions for engaging the pads on a printed circuit board mounted in the connector and intermediate regions which in the two rows are inclined upwardly toward each other a hollow insulative housing is mounted over the contacts onto the mounting member. The housing has an elongated slot in its upper wall for receiving a printed circuit board. A vertically slidable insulative element is provided in the housing. Such element preferably is in the form of a hollow shell positioned over the contacts. The shell has a printed circuit board receiving slot therein aligned with the slot in the outer housing. The contacting portions of the contacts are normally arranged out of the path of the slots so that when a printed circuit board is inserted into the slots, the contacts will not engage the board. The inner element or shell is formed with cam surfaces thereon which engage the intermediate regions of the two rows of contacts. When the element is shifted downwardly in the housing, the cam surfaces thereof which engage the intermediate regions of the contacts shift the contacts in the respective rows toward each other for engagement with the conductive pads on the board inserted into the connector housing. An elongated longitudinally movable cam extends lengthwise of the housing. Actuation of the cam moves the element downwardly in the housing to shift the contacts in the manner just described. Movement of the element by the cam is uniform and controlled thereby producing a uniform camming action against the contacts so that they will simultaneously engage the pads on the board mounted on the connector housing with a predetermined, controlled force. The cam has an actuation means adjacent to one end of the housing which is easily accessible to the user for actuating the cam and thus effecting electrical engagement between the contacts in the connector housing and the printed circuit board mounted therein.

Other aspects and advantages of the invention will become more apparent in view of the accompanying drawings taken in connection with the following description.

DESCRIPTION OF THE PREFERRED EMBODIMENT

Figure 1:
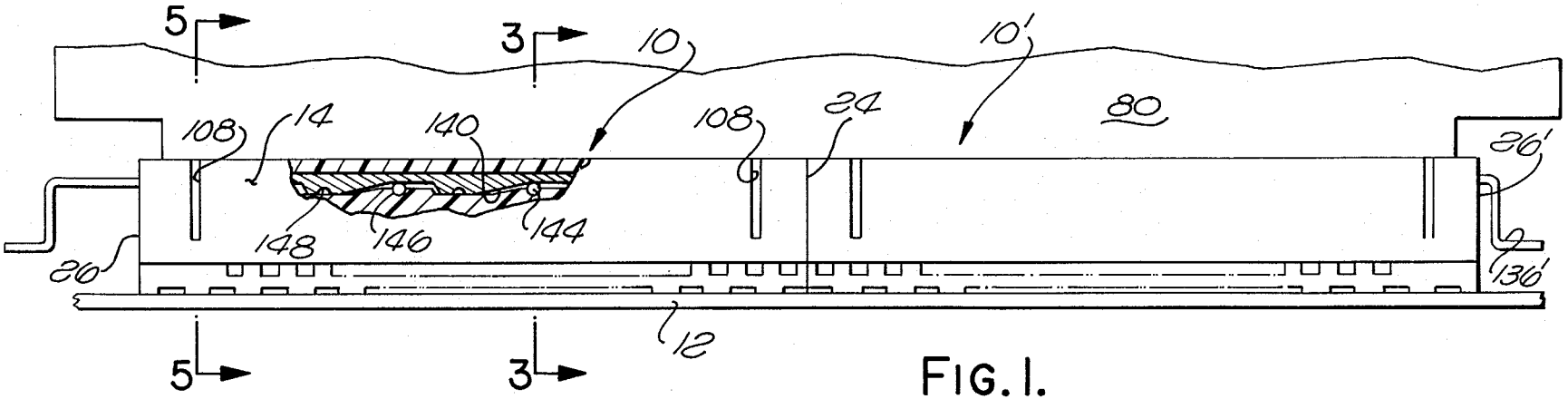
FIG. 1 is a side elevational view of a pair of connectors constructed in accordance with the present invention mounted on a planar substrate, with portions of one of the connector housings broken away to show the interior structure thereof.

Referring now to FIG. 1 of the drawings in detail, there is illustrated two connectors in accordance with the present invention, designated generally 10 and 10', respectively, which are mounted in longitudinal alignment on a mounting member 12. The mounting member is in the form of a planar substrate, which may be printed circuit board. The two connectors 10 and 10' are identical so that the following description with respect to one will be applicable to the other.

The connector 10 comprises an elongated insulative hollow housing, generally designated 14. The housing has a pair of spaced sidewalls 16 and 18 and an upper wall 20. An elongated printed circuit board receiving slot 22 is formed in the upper wall 20 and extends to the opposite ends 24 and 26 of the housing. The spaced sidewalls 16 and 18 define an elongated recess 28 within the housing 14 which opens at the bottom 30 of the housing.

Figure 6:
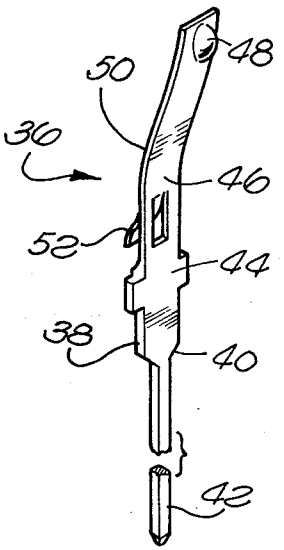
FIG. 6 is a perspective view of one of the contacts employed in the connector as illustrated in the preceding FIGURES.
Figure 3:
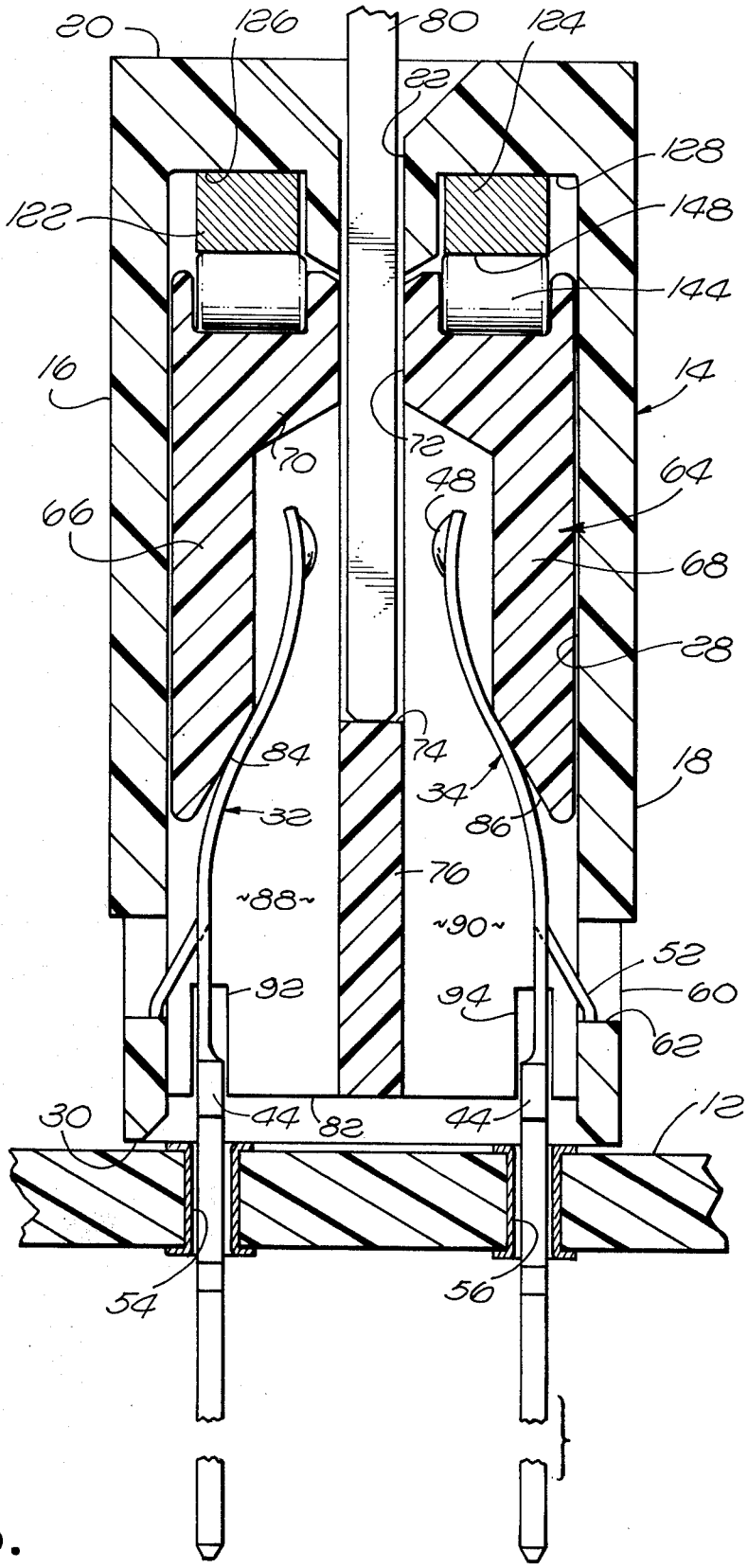
FIG. 3 is a vertical sectional view taken along line 3—3 of FIG. 1 showing the one connector in its unactuated position.
Figure 4:
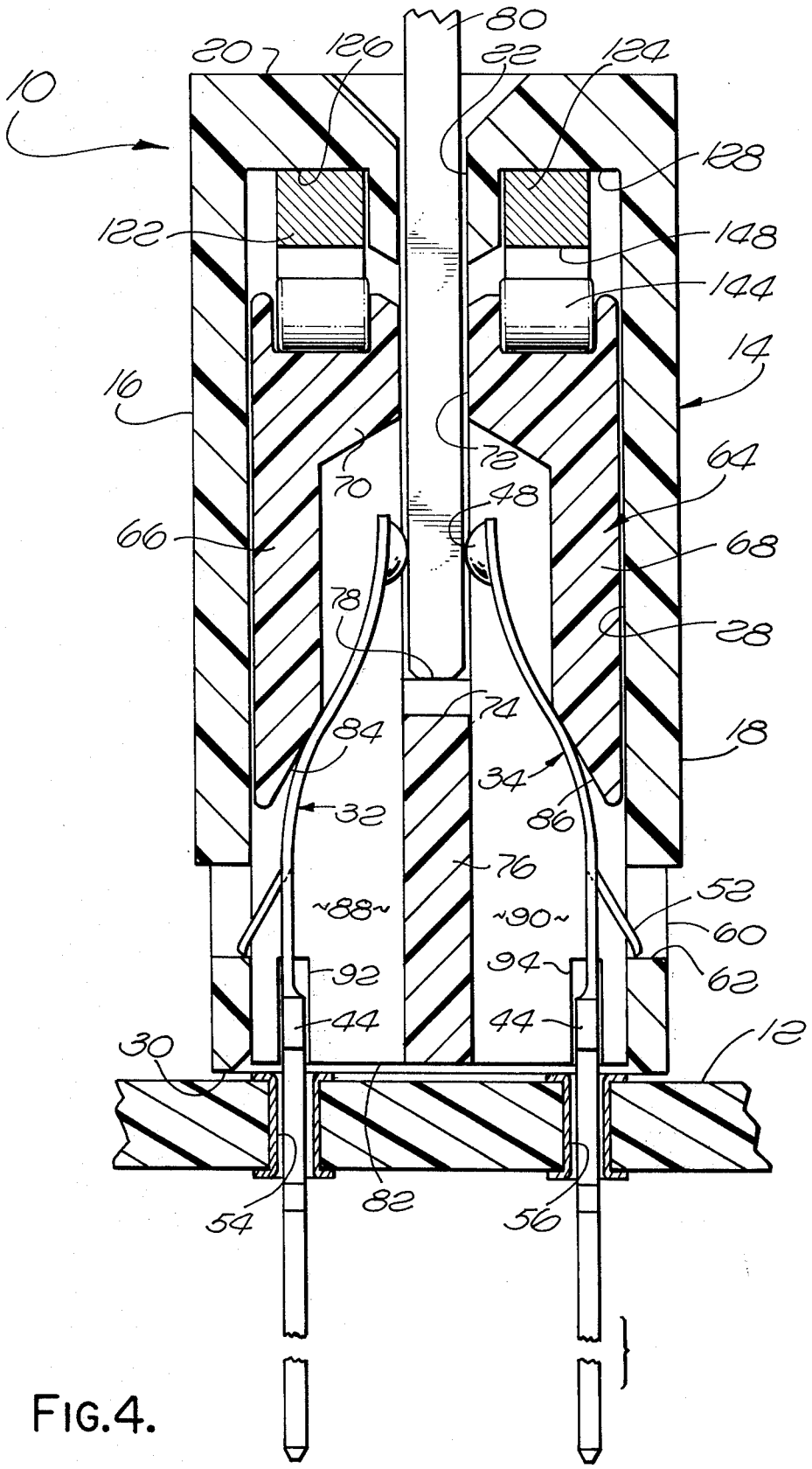
FIG. 4 is a vertical sectional view of the connector similar to FIG. 3 but showing the connector in its actuated position.

Two rows of contacts 32 and 34 are mounted in the printed circuit board 12. Reference is made to FIG. 6, which shows one of the contacts used in the connector, generally designated 36. It is to be understood that the contacts in the respective rows of contacts 32 and 34 are identical and the following description with respect to contact 36 applies to the contacts in each row. The contact 36 has a lower mounting portion 38 which tapers downwardly at 40 to a wire wrap tail. A shoulder 44 is located above the mounting portion 38 of the contact. The section 46 of the contact above the shoulder 44 is coined to a reduced thickness so that the upper section is resilient in the lateral direction, that is, in the direction toward the printed circuit board receiving slot 22 in the housing. The contact has an upper contacting portion 48 preferably in the form of a protuberance which provides a high unit force with a pad on a printed circuit board with which the contact is engaged upon actuation of the connector. Between the upper contacting portion 48 and the shoulder 44 of the contact there is provided an inclined intermediate region 50 between the intermediate region 50 and the shoulder 44, a locking time 52 is stamped out of the section 46 of the contact. This tine extends downwardly and outwardly when the contacts are mounted in the board 12 as best seen in FIGS. 3 and 4.

The board 12 has two rows of plated through holes 54 and 56 therein. The two rows of contacts 32 and 34 are mounted in the respective rows 54 and 56, with the lower mounting portions 38 of the contacts press fit into the plated through holes. With the contacts so mounted, it is seen that the wire wrap tails 42 extend downwardly below the board 12 and the upper portions of the contacts extend upwardly within the housing 14 on opposite sides of the slot 22. The shoulders 44 on the contacts facilitate the press fitting of the contacts into the plated through holes.

Each of the sidewalls 16 and 18 of the housing 14 is provided with a series of openings 60 which are spaced apart corresponding to the spacing of the contacts 32 and 34. The lower edge 62 of each opening 60 defines an upwardly facing shoulder which is engaged by the bottom of the locking tines 52 when the housing is mounted over the contacts onto the board 12. Hence, the locking tines serve to retain the housing on the board.

An insulative element 64 is vertically slidable within the housing 14. The element 64 is preferably in the form of a hollow shell having sidewalls 66 and 68 and an upper wall 70. The upper wall 70 is formed with a longitudinally extending slot 72 which extends to the opposite ends of the shell 64. The bottom 74 of the slot 72 is defined by the upper surface of a central rib 76 which extends longitudinally through the shell. The bottom 74 of the slot lines in the same horizontal plane as the bottom 78 of the slot 22 in housing 14 when the connector is in its unactuated position as illustrated in FIG. 3. As seen in FIG. 3, the slots 72 and 22 are aligned with each other. A printed circuit board 80 is shown as being positioned in the slots.

It is noted that the sidewalls 66 and 68 of the shell 64 terminate between the upper wall 70 and the bottom 82 of the shell. The bottoms of the sidewalls of the shell are tapered to provide upwardly and inwardly extending cam surfaces 84 and 86. These cam surfaces engage the inclined intermediate regions 50 of the contacts mounted in the board 12.

Each pair of opposing contacts in the row 32 and 34 are separated by laterally extending walls 88 and 90 on the shell 64 to assure that the contacts in each row are electrically isolated from each other. Vertical grooves 92 and 94 are formed in the separation walls 88 and 90, respectively, aligned with the lower portions of the contacts 32 and 34. The shoulders 44 on the contacts extend into the grooves 92 and 94 to provide positive vertical alignment of the shell 64 with respect to the contacts.

Figure 5:
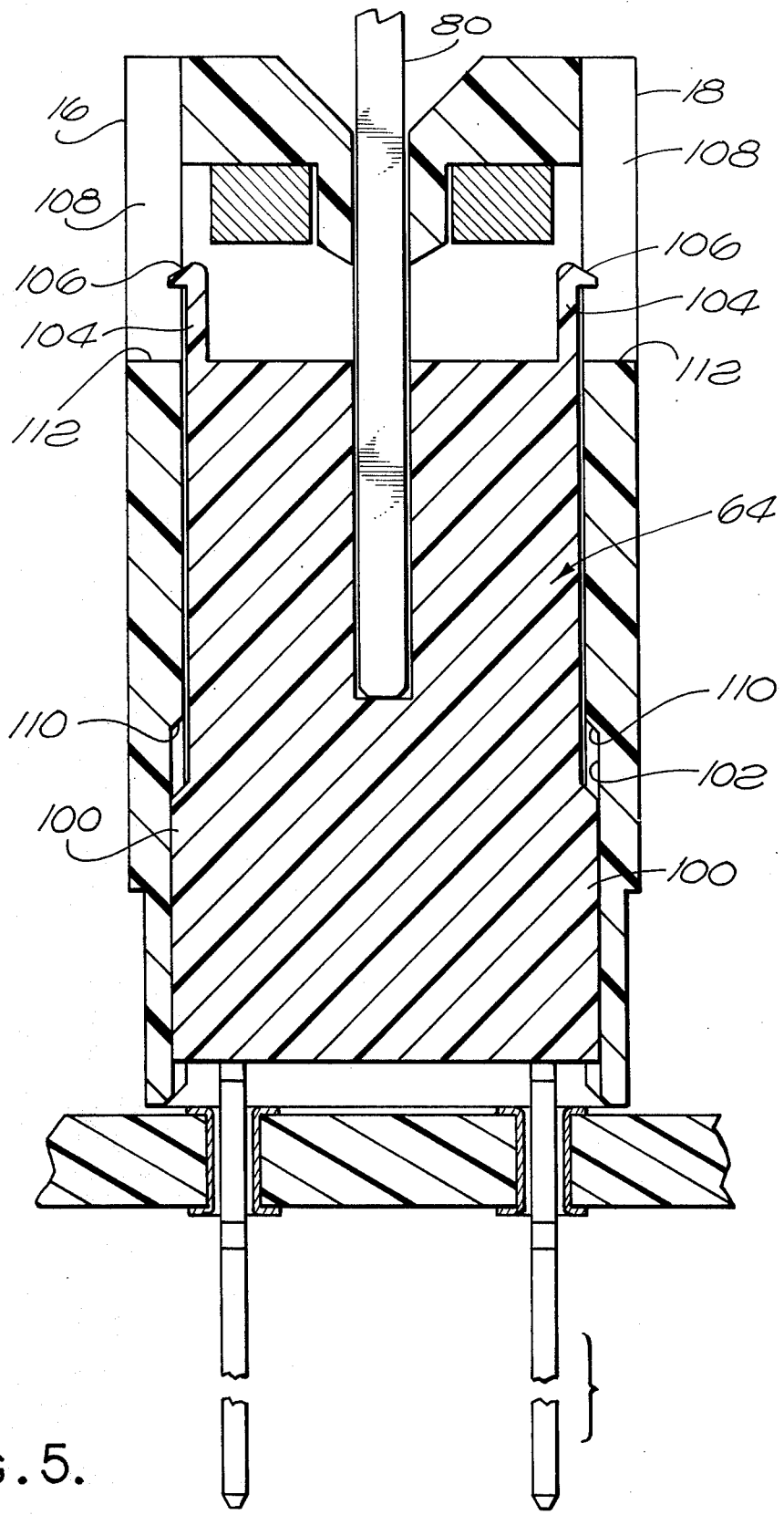
FIG. 5 is a vertical sectional view taken along line 5—5 of FIG. 1.

As seen in FIG. 5, outwardly and vertically extending tongues 100 are formed on the outer surfaces of the shell 64. Preferably these tongues are provided in at least two longitudinally spaced locations on the shell, such as adjacent to the ends of the shell. The tongues 100 slidably engage mating grooves 102 formed in the inner surface of the sidewalls 16 and 18 of the housing 14. This tongue-and-groove arrangement assures proper longitudinal position of the shell with respect to the housing 14, and also provides a uniform, controlled sliding interconnection between the two parts.

The shell 64 is assembled within the housing 14 by inserting the shell upwardly through the bottom 30 of the housing into the recess 28. In order to retain the shell within the housing so that the two parts will not become separated during handling thereof prior to mounting the housing on the board 12, there is provided a pair of vertically extending resilient fingers 104 on the upper part of the shell adjacent to its opposite ends. Each finger has an outwardly extending latch element 106 which engages within a vertical slot 108 formed in each of the sidewalls 16 and 18 of the connector housing. When the shell is pushed upwardly into the recess 28 in the housing, the resilient fingers 104 initially pass upwardly through the grooves 102 in the housing and then are cammed inwardly by cam surfaces 110 at the upper ends of the groove. When the latch elements 106 on the fingers pass the bottoms 112 of the slots 108 in the housing, the latch elements snap outwardly into the slots due to the resiliency of the fingers 104, thus assuming the position illustrated in FIG. 5. The latch elements 106 on the fingers 104 cooperate with the bottoms 112 of slots 108 to prevent the shell from becoming disassembled from the housing 14. It will be appreciated that the resilient fingers 104 can be depressed inwardly by inserting a suitable tool through the slots 108 in order to position the latch elements 106 inside the sidewalls 16 and 18 of the housing so that the shell 12 may be removed from the bottom of the housing.

Figure 2:
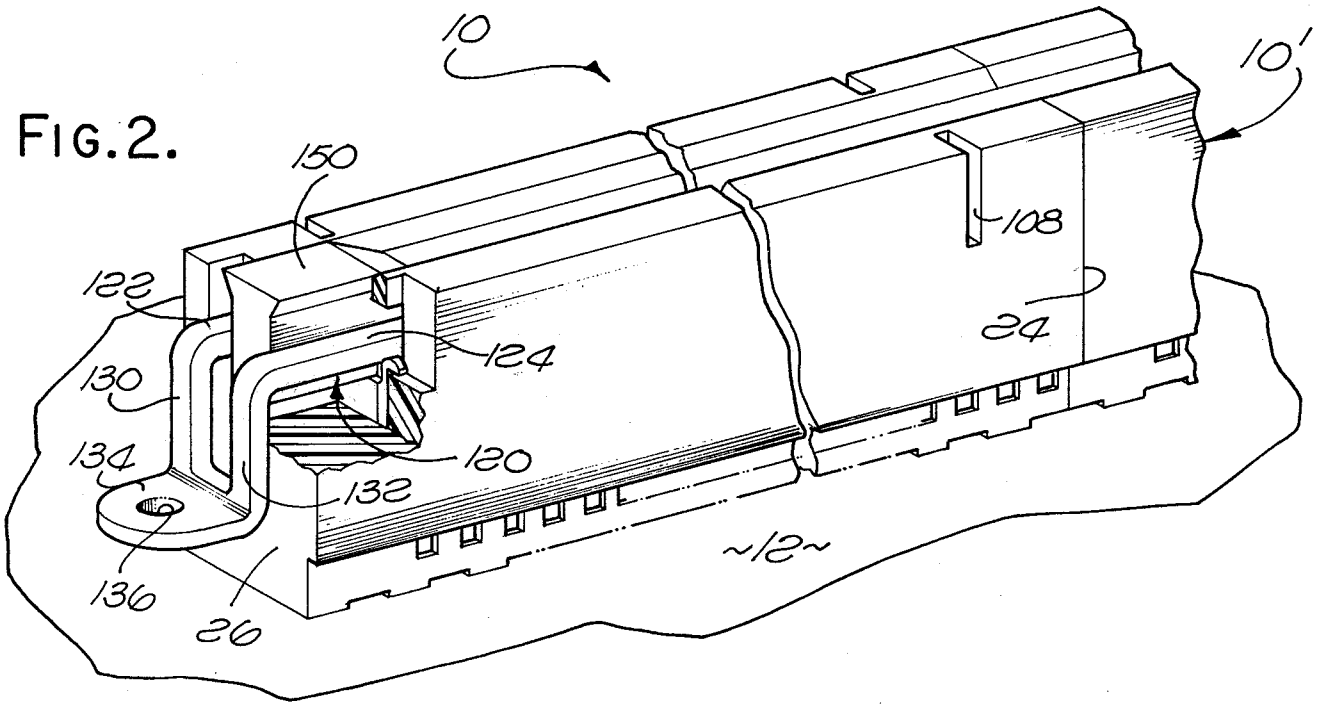
FIG. 2 is an enlarged perspective view of one of the connectors illustrated in FIG. 1, with portions of the connector housing broken away to show further details of its interior structure.

As seen in FIG. 3, the intermediate regions 50 of the contacts in the two rows 32 and 34 are inclined upwardly toward each other in the direction of the slots 22 and 72. In the unactuated position of the connector as illustrated in FIG. 3, the upper contacting position 48 of each pair of opposing contacts in the two rows 32 and 34 are spaced apart a distance greater than the width of the slots 22 and 72 so that the contacts will not engage the printed circuit board 80 when it is initally inserted through the slots into the connector. In order to actuate the contacts so as to move the contacting portions 48 inwardly toward a vertical plane passing through the slots 22 and 72 to engage conductive pads, not shown, on the edge of the board 80, the shell 64 must be shifted downwardly within the housing 14 to side cam the contacts by virtue of the engagement of the cam surfaces 86 on the bottom of the shell with the intermediate regions 50 of the contacts. To this end, there is provided an elongated longitudinally movable actuating cam device, generally designated 120, which is positioned between the upper wall 70 of the shell and the upper wall 20 of the housing. The actuating cam device comprises a pair of cam rods 122 and 124 which are longitudinally slidable in recesses 126 and 128 respectively in the housing on opposite sides of the slot 22. As seen in FIGS. 1 and 2, the ends of the rods 122 and 124 extend outside the end 26 of the housing 14 and are bent downwardly to provide vertical arms 130 and 132, respectively, which are connected together by a plate 134 which is positioned below the bottom 78 of the printed circuit board receiving slot 22. The plate 134, which is provided with an aperture 136, comprises actuator means for longitudinally moving the cam rods 122 and 124 within the housing. It will be appreciated that because the actuator plate 134 extends outwardly beyond the end of the housing 14, it is readily accessible for operation by the user.

As seen in FIG. 1, the bottom of each cam rod 122 and 124 is formed with a plurality of longitudinally spaced downwardly facing inclined ramps 140. The upper surface of the upper wall 70 of shell 64 is formed with upwardly facing inclined surfaces or ramps 142 which are complementary to and oppose the ramps 140 on the rods 122 and 124. A roller bearing 144 is mounted in an arcuate groove 146 in each of the ramps 142 adjacent to the upper ends of the ramps. A portion of each roller bearing 144 extends above the upper surface of the ramp 142 for making rolling engagement with the corresponding inclinded ramps 140 on the rods 122 and 124. It will be appreciated that by pulling the cam rods 122 and 124 in the rightward direction indicated by the arrow in FIG. 1, designated "pull to activate," the inclined ramps 140 will slide over the roller bearings 144 thereby camming the shell 64 downwardly within the housing 14. As explained previously, such downward movement of the shell within the housing side cams the contacts in the two rows 32 and 34 into engagement with the printed circuit board 80 as seen in FIG. 4. The contacts will engage the pads on the board with a high unit force and with a slight wiping action, thereby assuring good electrical engagement therebetween Preferably, notches 148 are formed in the downwardly facing ramps 140 on the cam rods 122 and 124 adjacent to the lower ends of the ramps which become aligned with and therefore receive the roller bearings 144 when the cam rods are in their fully actuated position. The roller bearings and notches 148 thereby provide a detent arrangement which serves to retain the cam rods 122 and 124 in their actuated position, thereby preventing them from becoming unlocked due to shock and vibration which would otherwise result in possible disengagement of the contacts from the printed circuit board 80. It will be appreciated that by virtue of the use of the roller bearings 144, a lower actuating force is required for pulling the actuating cam device 120 to actuate the contacts than if the inclined surfaces 140 and 142 slidably engaged with each other, and less cam wear occurs. In order to inactivate the contacts in the connector 10, the actuator plate 134 is shifted in the leftward direction indicated by the arrow in FIG. 1, designated "pull to disengage," which relieves the the cam force on the roller bearings and hence shell 64. Due to the geometry of the upper spring portions 46 on the contacts, the contacts produce a steady upward force acting upon the cam surfaces 86 on the bottom of the shell, thereby urging the shell in an upward direction within the housing 14. Hence, when the actuating cam devie 120 is moved to its inactive position, the contacts automatically return the shell 64 from its acutating position illustrated in FIG. 4 to its unactuated position illustrated in FIG. 3.

An edge card guide and card stop member 150 may be mounted in the slot 22 at any desired position depending upon the length of the PC board 80. Only one of such stops 150 is illustrated in FIG. 2, and is positioned adjacent to the end 26 of the housing 14. The member 150 may be simply snapped into the slot 22 and held therein by friction. The member 150 may be readily removed. When it is removed, the board 80 may be slid into the slot 22 from either end of the housing because the actuator plate 134 of the actuating cam device 120 is disposed below the bottom of the slot and thus will not interfere in the end insertion of the board into the connector. Since the board may be inserted into the housing from the end, it will be appreciated that less space is required above the connector than in the case when the board must be inserted from the top. Because of this feature, and also because the actuator plate 134 is disposed at the end of the connector housing, a large number of connectors may be mounted in close side-by-side relationship upon the mounting board 12 and only a minimum amount of space is required above the connector for insertion of the board, thus leading to high density electronic packaging.

Referring again to FIGS. 1 and 2, it is noted that the two connectors 10 and 10' are mounted in longitudinal alignment on the board 12. No card guide or card stop member 50 is provided in the adjacent ends of the connector housings so that there is a continuous slot extending lengthwise of the two connectors which receives the printed circuit board 80 that may be longer than either of the individual connectors. As illustrated, the board 80 extends the entire length of the two connectors. The cam rods 122 and 124 of the actuating cam device 120 extends lengthwise entirely through the two connectors, and the rods are connected to a second actuator plate 136' adjacent to the end 26' of the connector 10'. In order to actuate the contacts in both of the connectors 10 and 10', the actuator plate 136' is moved in the rightward direction as viewed in FIG. 1 and indicated by the arrow designated "pull to actuate" so that the shells in each of the connector housings are pushed downwardly simultaneously. As a consequence, the contacts in the two connectors 10 and 10' are actuated simultaneously by a simple pulling force on the actuating cam device 120. As previously explained, pulling of the device 120 in the leftward direction indicated by the arrow designated "pull to disengage," the contacts are simultaneously disengaged allowing the board 80 to be removed from the connectors. Thus, the connector of the present invention may be utilized either alone or in combination with two and even more connectors in alignment depending upon the length of the board 80 which is to be inserted into the assembly.

In order to assemble the connector 10, the actuating cam device 120 is initally positioned in the recesses 126 and 124 of the housing 14 with the actuator plate 134 extending outside the end 26 of the housing. The shell 64 with the roller bearings 144 in position is then slid upwardly into the housing. As the shell moves upwardly, the resilient fingers 144 at the upper part of the shell initially slide through the grooves 102 in the sidewalls of the housing and then deflect inwardly until the latch fingers 106 pass the bottoms 112 of slots 108 thereby retaining the shell within the housing so that the assembly may be conveniently handled and transported. The contacts are pressfit into the plated through holes in the mounting board 12. The housing 14 with the shell therein is then mounted downwardly over the contacts. The sidewalls 16 and 18 of the housing will deflect the locking tines 52 on the contacts inwardly until the housing is mounted onto the board in which position of the housing the locking tines 52 spring outwardly into the openings 60 in the sidewalls. As previously explained, the lower ends of the tines engage the lower edges of the openings 60 to releasably retain the housing and shell on the mounting board. In order to remove the housing and shell from the board, a suitable tool, not shown, in the form of a comb is positioned with its teeth extending into holes 60 to release the tines from the lower edges 62 of the holes. In use of the connector 10, the PC board 80 is inserted through the slots 22 and 72 with zero insertion force, since the contacting portions 48 of the contacts are normally positioned outside of the slots as seen in FIG. 3. To actuate the contacts, the actuator plate 134 is shifted in the rightward direction as viewed in FIG. 3 to slide the cam rods 122 and 124 over the roller bearings thereby forcing the shell 64 downwardly to side cam the contacts into engagement with the board 80 as seen in FIG. 4. Due to the tongue-and-groove sliding connection 100, 102 between the shell and the housing, and the sliding interengagement between the grooves 92 and 94 on the contact separation walls of the shell and the shoulders 44 on the contacts, the shell is moved in a smooth, uniform controlled manner upon actuation of the cam device 120, providing consistent cam action and spring loading of the contacts against the printed circuit board 80.

We claim:

1. A printed circuit board connector comprising:

a mounting member having two rows of holes therein;

two rows of resilient contacts having lower mounting portions mounted in said two rows of holes respectively in said mounting member;

each said contact having an upper contact portion and an intermediate region between said upper and lower portions, the intermediate regions of said contacts of said two rows of contacts being inclined upwardly toward each other;

an elongated hollow insulative housing mounted over said contacts onto said mounting member, said housing having an upper wall with a printed circuit board receiving slot therein between said two rows of contacts;

a vertically slidable, inverted, insulative hollow shell mounted over said two rows of contacts within said housing, said shell having an upper wall with a printed circuit board receiving slot therein aligned with said first-mentioned slot, said shell having cam surface means thereon engaging said intermediate regions of said contacts of said two rows of contacts, said cam surface means actuating said upper portions of said contacts of said two rows of contacts transversely towards each other upon downward movement of said shell in said housing; and elongated longitudinally movable actuating cam means in said housing between said upper walls of said housing and said shell, movement of said actuating cam means moving said shell downwardly to simultaneously actuate said contacts, said actuating cam means comprising a pair of parallel, spaced cam rods on opposite sides of a vertical plane passing through said slots.

2. A printed circuit board connector as set forth in claim 1 wherein:

each said cam rod has at least one downwardly facing ramp surface thereon; and said upper wall of said shell has upwardly facing inclined surfaces generally complementary to said ramp surfaces.

3. A printed circuit board connector as set forth in claim 2 including:

a roller bearing between each said ramp surface and said inclined surface.

4. A printed circuit board as set forth in claim 2 including:

a roller bearing mounted in one of said surfaces engaging the other of said surfaces; and a notch in said other surface receiving said roller bearing when said actuating cam means actuates and contacts.

5. A printed ciruit board connector as set forth in claim 1 wherein:

said contacts of said two rows of contacts have downwardly and outwardly extending tines thereon; and said housing has a pair of sidewalls with upwardly facing shoulders adjacent the inner surfaces thereof engaged by said tines whereby said tines releasably retain said housing on said mounting member.

6. A printed circuit board connector as set forth in claim 6 wherein:

each said sidewall has a plurality of openings therethrough each receiving one of said tines, the lower edges of said openings defining said upwardly facing shoulders.

7. A printed circuit board connector as set forth in claim 1 wherein:

said shell has a pair of sidewalls, said cam surface means being provided on the bottoms of said sidewalls.

8. A printed circuit board connector as set forth in claim 1 wherein:

each said cam rod has an end extending outwardly beyond an end of said housing and actuator means connecting said rod ends.

9. A printed circuit board connector assembly comprising:

a mounting member;

a pair of elongated insulative housings mounted in longitudinal alignment on said mounting member, said housings having longitudinally aligned continuous slots therein for receiving the edge of a printed circuit board longer than either of said housings;

a row of resilient contacts in each of said housings positoned adjacent to the slot therein; and a single continuous elongated longitudinally movable cam actuating element extending through said housings, movement of said cam actuating element simultaneously actuating said contacts in said housings to shift said contacts toward a vertical plane passing through said slots.

* * * * *